United States Patent [19]

Knirsch et al.

[11] 3,950,600

[45] Apr. 13, 1976

[54] THERMOSENSITIVE ELEMENT, AND ITS EMPLOY IN THE THERMOGRAPHIC REPRODUCTION OR RECORD SYSTEMS

[75] Inventors: Franco Knirsch, Pavone (Turin); Dino Lavagna, Ivrea (Turin); Giorgio Rossi, Banchette (Turin), all of Italy

[73] Assignee: Ing. C. Olivetti & C., S.p.A., Ivrea (Turin), Italy

[22] Filed: July 8, 1974

[21] Appl. No.: 486,709

[30] Foreign Application Priority Data

July 27, 1973 Italy ..... 69267/73

[52] U.S. Cl. ..... 428/327; 427/145; 427/151; 428/500; 428/509; 428/913

[51] Int. Cl.[2] ..... B41M 5/18

[58] Field of Search ..... 117/36.7, 36.8; 101/469; 346/1; 428/327, 500, 509

[56] References Cited

UNITED STATES PATENTS

| | | | |
|---|---|---|---|
| 2,663,656 | 12/1953 | Miller et al. | 117/36.7 |
| 2,967,785 | 1/1961 | Allen et al. | 117/36.7 |
| 3,244,549 | 4/1966 | Farnham et al. | 117/36.2 |
| 3,451,338 | 6/1969 | Baum | 101/469 |
| 3,539,375 | 11/1970 | Baum | 117/36.2 |
| 3,561,991 | 2/1971 | Baum | 117/36.7 X |
| 3,666,525 | 5/1972 | Kimura et al. | 117/36.8 |
| 3,792,481 | 2/1974 | Nagashima et al. | 346/1 |

*Primary Examiner*—Thomas J. Herbert, Jr.
*Attorney, Agent, or Firm*—I. J. Schaefer

[57] ABSTRACT

A temperature-responsive record material for use in a thermographic recording and reproducing apparatus comprising a supporting sheet carrying a single layer containing, as the temperature-sensitive composition, a mixture resulting by a dispersion of a basic chromogenic compound and of an acidic compound in a binder having as assential binding agent a latex or a mixture of a latex with a non-ionic cellulose ether.

12 Claims, No Drawings

THERMOSENSITIVE ELEMENT, AND ITS EMPLOY IN THE THERMOGRAPHIC REPRODUCTION OR RECORD SYSTEMS

BACKGROUND OF THE INVENTION

1. Field of the Invention

The invention is concerned with a temperature-responsive record material for use in thermographic recording and reproducing systems and, more particularly an improved heat-sensitive record material comprising a supporting sheet provided with a heat-sensitive composition containing, in a single layer, mark forming components which react to produce a mark according to a selectively applied temperature pattern.

More particularly, the record element referring to the invention is adapted to be used for the data record in the systems wherein there are used as printing means, heated metal pins, thermic heads or any other device that transmits thermic energy.

2. Description of the Prior Art

Known in the literature there is the existence, which is therefore no object of the invention, of some colorless basic chromogenic compounds capable of being transformed into the colored form when coming into contact with acid or ionizing environments.

These compounds are, usually, leuco-compounds of triphenylmethane and fluorane dyestuffs having a lactonic structure and, among the most known thereof, there are cited here below: - 3,3-bis-(4-dimethylaminophenyl)-6-dimethylphthalide (Crystal Violet Lactone or CVL), giving a colour from blue to violet; - 3,3-bis-(p-dimethylaminophenyl)-phthalide or (Malachite Green Lactone or MGL), giving a green color; - Xanthene-9,0-benzoic acid, 3,6-bis-dimethylamino-9-p-nitroaniline lactam, giving a red color; - N-(p-nitrophenyl)-Rhodamine B-lactam (RBL) and 3′,6′-bis-diethylaminofluorane both giving a red color.

In order to establish the acid or ionizing environment needed for their reaction, there are usually employed tannic acid, gallic acid, phenols, polyphenols and phenolic resins, anhydrides, anilides, imides, attapulgite, silica, etc.

It is furthermore known the use, for thermographic purposes, of layers containing, as a thermosensitive compound, mixtures of a basic chromogenic compound and an acidic compound. By selectively applying heat to said layers, the acidic compound melts thereby giving the suitable medium for turning the basic chromogenic compound into its colored form.

Nevertheless, temperature-responsive elements as above described show a marked tendency to develop color also in the absence of heat, so that this phenomenon already occurs by operating the mixture of the single dispersions comprising respectively the basic chromogenic compound and the acid compound.

In fact, the dispersions of CVL and acidic compounds, obtained by using water-soluble binders like casein, starch, modified starchs, pectine, polyvinyl acetate/crotonic acid copolymers, alkali-soluble phenolformaldehyde resins, polyvinylpyrocolidone and copolymers of it, gum arabic, urea-formaldehyde resins, etc. when mixed, give immediately a greenish color turning rapidly to a hell blue and dark blue color. In many cases, already the CVL dispersion appears greenish colored.

Besides the above cited inconveniences the specified thermographic layers also show a poor resistance to abrasion and to the operative conditions, owing to the presence of the water-soluble binders and to the low binding power of the colloid used in the dispersion.

SUMMARY OF THE INVENTION

A main object of the present invention is the preparation of dispersions of basic chromogenic compounds and of acid compounds, as well as of thermo-responsive layers containing same, which do not show the inconvenience of an untimely colored reaction until their real employment in thermo-sensitive recording systems and similar, and on the contrary provide layers of very good mechanic and coating uniformity characteristics.

Thus, according to the invention, there is provided an improved temperature-sensitive material, for use in a thermographic recording and reproducing apparatus, comprising a supporting sheet carrying a single layer containing, as the temperature-sensitive composition, a mixture resulting by dispersions of a crystal violet lactone and of an a phenolic compound in a binder, said composition being characterized in that as an essential binder a latex or a mixture of a latex with a non-ionic cellulose ether is used.

With the term "latex" is hereinafter intended a colloidal dispersion in water of synthetic polymers and/or copolymers which, being applied onto any surface, provides a transparent and homogeneous layer. If a pigment is added to the latex, the particles thereof become an integrant part of the dried layer.

According to the invention, it has been found that the use of latexes or mixtures thereof with non-ionic cellulose ethers as bidners allows the preparation of dispersions which are stable for a long time, as well as of temperature-responsive layers which are perfectly colorless at room conditions, and able to promptly develop color by heat, still keeping unchanged the good mechanic and layer uniformity characteristics.

It is known from the colloid chemistry that the latexes, bearing electric charges, undergo an immediate coagulation in the presence of pigments or other substances bearing a different charge.

A further object of the invention is therefore to individualize the latexes which either do not show said inconvenience of a coagulation in the presence of substances used for preparing the temperature-responsive layer, or for which the coagulation can be prevented by the use of a protective colloid.

DESCRIPTION OF THE PREFERRED EMBODIMENTS

The latexes being conveniently usable for the production of temperature-responsive layers according to the invention, belong to the following classes:

vinyl chloride copolymers
polystyrene
styrene-butadiene copolymers
styrene-butadiene carboxylate copolymers
modified acrylic copolymers
acrylic copolymers reticulated with zinc.

As a protective colloid for preventing the coagulation of the latexes not belonging to the classes just mentioned above, a non-ionic cellulose ether may be advantageously used of the type specified by Applicant in the copending U.S. Pat. application Ser. No. 499,702 filed on Aug. 22, 1974, which is a continuation application of Ser. No. 309,838 filed on Nov. 27, 1972 and now abandoned.

The use of synthetic polymers or copolymers as binders results in thermoresponsive layers showing characteristics similar to those of layers prepared by dispersing synthetic polymeric binders with solvents, and which show very good uniformity and good mechanic characteristics, without disadvantages.

In the temperature-responsive layers comprising the binders according to the invention, further auxiliary substances are incorporated which, not characterizing yet the dispersion, contribute to improve the mechanic and optical characteristics of the so achieved layers. These auxiliary substances may be in particular: lubricating agents such as metal stearate, in particular calcium, magnesium, lithium and aluminium stearates, waxes, the microtalc; absorbing pigments, such as silicates, clays, kaolin, zinc oxide, barium sulphate, talc, etc., optical whitening agents of the type used in the paper processing in general. The addition of these auxiliary components to the thermosensitive components according to the invention has proved particularly advantageous in those thermic writing and printing systems where a thermal writing head moving in contact with the layer is employed, as described by applicant by example in the copending U.S. Pat. application Ser. No. 309,838 filed on Nov. 27, 1972, in absence of said auxiliary additions, smudgment of the surface of the writing head in contact with the recording layer would occur.

The dispersions described below may be prepared using all known means of the technique and the rations of their components may be varied within a wide extent, always achieving good practical results.

When a mixture of latex with non-ionic cellulose ethers is used as the binder, the ratio of such mixture can be comprised between 100–0 parts and 3–97 parts by weight, bearing in mind that the ratio binder/solids may vary between 1:1 and 1:25.

The following examples will disclose some embodiments of the invention, without taking up a limiting character thereof.

EXAMPLE 1

The following dispersions are separately prepared:

A. A porcelain attritor (750 cc) was charged with 5 g of Crystal Violet Lactone (CVL), 20 g of Lutofan 300 D (Registered Trade Mark for a water dispersion without plasticizers based upon vinyl chloride, manufactured by the B.A.S.F., Badische Anilin *u.* Soda Fabrik) and 15.5 cc of water. The ingredients are ground for 24 hours and the mixture filtered.

B. A porcelain attritor (750 cc) was charged with 40 g of 4.4′-isopropylidenediphenol, 34 g of Lutofan 33 D and 106 cc of water. The ingredients are ground for 24 hours and the mixture filtered. 180 parts of A and 180 parts of B were mixed together, the resulting mixture was coated on paper weighing 55 g/m², thus obtaining layers having a dry weight of 3–5 g/m².

The thus obtained layer gives by heating in contact with a heated pin or a thermic printing head, light and humidity resistant blue colored marks.

EXAMPLE 2

The following dispersions are separately prepared:

A. A porcelain attritor (750 cc) was charged with 5 g of Crystal Violet Lactone (CVL), 10 g of Lithium stearate, 20 g of Lutofan 300 D and 40 g of zinc oxide, and added with 1 g of Tintofen HS-76 (Registered Trade Mark for optical whitening agents of the class of the stilbene and coumarine derivatives, manufactured by the GAF, General Aniline & Film Corp.) and 120 cc of water. The ingredients are ground for 24 hours.

B. A porcelain attritor (750 cc) was charged with 40 g of 4.4′-isopropyliden-diphenol, 40 g of zinc oxide, 34 g of Lutofen 300 D, 1 g of Tintofen HS-76 and 150 cc of water; the ingredients are ground for 24 hours.

196 parts of A and 265 parts of B were mixed together and the resulting mixture was coated on paper weighing 55 g/m², thus obtaining layers having a dry weight of 5 – 7 gm².

The so prepared layer gives, when heated by contact with a thermic printing element, perfectly light and humidity resistant blue colored marks.

EXAMPLE 3

Same as described in Example 1; by using as the binder Polyco 220 NS (Registered Trade Mark for polystirene emulsions manufactured by the Borden Chemical Co.), in the same proportion and with similar results.

EXAMPLE 4

Like Example 1, employing as the binder Dow Latex 636 (Registered Trade Mark for the styrene/butadiene dispersion manufactured by the Dow Chemical Co.)

EXAMPLE 5

Like Example 1, employing as the binder Dow Latex 815 (Registered Trade Mark for a styrene-butadiene carboxylate dispersion manufactured by the Dow Chemical Co.)

EXAMPLE 6

Like Example 1, employing as the binder Dow Latex 816 (Registered Trade Mark for a styrene-butadiene carboxilate manufactured by the Dow Chemical Co.).

EXAMPLE 7

Like Example 1, employing as the binder Primal B-231 (Registered Trade Mark for a modified acrylic copolymer manufactured by the Rohm & Haas Co.).

EXAMPLE 8

Like Example 1, employing as the binder Primal B-505 (Registered Trade Mark for an acrylic copolymer reticulated with zinc, manufactured by the Rohm & Haas Co.).

EXAMPLE 9

The following dispersions are separately prepared by charging in a porcelain attritor and grinding for 24 hours:

A. 15 g of Crystal Violet Lactone (CVL), 15 g of lithum stearate, 300 g of an acqueous solution of 2% Methocel HG-90 (Registered Trade Mark for a non-ionic cellulose ether of hydroxy-propyl methyl-cellulose, manufactured by the Dow Chemical Co.) and 150 cc of water.

B. 120 g of 4.4′-isopropylidenediphenol, 3 g of Tintofen HS-76, 42 g of Dow Latex 636 and 300 cc of water.

48 parts by weight of A and 46.5 parts of B were mixed together, and the resulting mixture was coated on paper, thus obtaining a thermosensitive element which, by heating, gives blue marks of good definition and conservation.

EXAMPLE 10

The following dispersions are separately prepared by charging in a porcelain attritor and grinding as per the preceding Examples:

A. 1 g of Vermillon (Registered Trade Mark for a basic chromogenic substance manufactured by the Nisso Kako Co.), 5 g of Wax C (Registered Trade Mark for an amido was manufactured by Hoechst), 40 g of an aqueous solution of 2% Methocel MC 15 cps (Registered Trade Mark for a methyl-cellulose having a substitution grades in methoxyle 27.5 – 31.5 produced by the Dow Chemical Co.);

B. 8 g of 4.4'-isopropylidenediphenol, 40 g of a 5% solution of Methocel 15 cps and 2.8 grs of Dow Latex 636.

46 parts by weight of A and 50.8 parts of B were mixed together. The temperature-responsive paper prepared by using the above mentioned mixture, gives by selective heating vermillon red marks of good definition and conservation.

It will be obvious to those skilled in the art that various changes may be made without departing from the scope of the invention.

What we claim is:

1. In a temperature responsive record material comprising a supporting sheet having a single layer coated thereon comprising finely divided solid particles of a crystal violet lactone and finely divided particles of 4-4-isopropylidene-diphenol, wherein the improvement comprises having the particles dispersed in a binder matrix comprising a non-ionic cellulose ether mixed with a latex in a ratio of non-ionic cellulose ether to latex not greater than 3–97 parts by weight, the employ ratio of binding means/solids being variable from 1–1 to 1–25.

2. In a record material according to claim 1, wherein said latex comprises a dispersion of vinyl chloride copolymer in water.

3. In a record material according to claim 1, wherein said latex comprises a dispersion of polystyrene in water.

4. In a record material according to claim 1, wherein said latex comprises a dispersion of styrene-butadiene copolymer in water.

5. In a record material according to claim 1, wherein said latex comprises a dispersion of styrene-butadiene carboxylate in water.

6. In a record material according to claim 1, wherein said latex comprises a dispersion of modified acrylic copolymer in water.

7. In a record material according to claim 1, wherein said latex comprises a dispersion of reticulated zinc acrylic copolymer in water.

8. In a record material according to claim 1, wherein said coating further comprises a white or lightly colored absorbing pigment.

9. In a record material according to claim 1, wherein said coating further comprises a lubricating agent.

10. In a record material according to claim 9, wherein said lubricating agent is a wax, a metal soap or a pigment.

11. In a record material according to claim 9, wherein said lubrication agent is a calcium, magnesium, silver, lithium or aluminum stearate.

12. In a record material according to claim 1, wherein said coating further comprises an optical whitening agent.

* * * * *